US009804555B2

(12) United States Patent
Yoshida et al.

(10) Patent No.: US 9,804,555 B2
(45) Date of Patent: Oct. 31, 2017

(54) POSITIONING MEMBER AND IMAGE FORMING APPARATUS

(71) Applicant: CANON KABUSHIKI KAISHA, Tokyo (JP)

(72) Inventors: Keisuke Yoshida, Kashiwa (JP); Takeshi Fukuda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/080,579

(22) Filed: Mar. 24, 2016

(65) Prior Publication Data

US 2016/0209802 A1 Jul. 21, 2016

Related U.S. Application Data

(63) Continuation of application No. PCT/JP2014/076338, filed on Sep. 25, 2014.

(30) Foreign Application Priority Data

Sep. 26, 2013 (JP) ..... 2013-199178

(51) Int. Cl.
*G03G 21/16* (2006.01)

(52) U.S. Cl.
CPC ..... *G03G 21/1647* (2013.01); *G03G 21/1685* (2013.01); *G03G 21/1619* (2013.01); *G03G 21/1695* (2013.01); *G03G 2215/2035* (2013.01)

(58) Field of Classification Search
CPC ..... G03G 21/1647; G03G 21/1685; G03G 21/1619; G03G 21/1695; G03G 2215/2035
See application file for complete search history.

(56) References Cited

U.S. PATENT DOCUMENTS

| | | | | |
|---|---|---|---|---|
| 5,528,523 | A | 6/1996 | Yoshida | |
| 5,957,261 | A | 9/1999 | Inoue et al. | |
| 8,755,732 | B2 * | 6/2014 | Ehara | G03G 15/657 399/121 |
| 2002/0028089 | A1 * | 3/2002 | Yoneda | G03G 15/2064 399/122 |

FOREIGN PATENT DOCUMENTS

| | | | |
|---|---|---|---|
| JP | 6-54011 | U | 7/1994 |
| JP | 2005-292612 | A | 10/2005 |
| JP | 2008-046154 | A | 2/2008 |

OTHER PUBLICATIONS

PCT International Search Report and Written Opinion dated Jan. 13, 2015 in International Application PCT/JP2014/076338.

* cited by examiner

*Primary Examiner* — Joseph S Wong
(74) *Attorney, Agent, or Firm* — Fitzpatrick, Cella, Harper & Scinto

(57) ABSTRACT

A positioning member is configured to be fixed to a main assembly frame of an image forming apparatus and configured to position a fixing device. The positioning member includes a mounting portion, a first projected portion configured to be inserted into a first hole of the main assembly frame, a second projected portion configured to be inserted into a second hole of the main assembly frame, and a third projected portion configured to be inserted into a third hole of the main assembly frame. The third projected portion includes a snap-off facilitating portion that snaps off in order to permit movement of the positioning member relative to the main assembly frame.

41 Claims, 12 Drawing Sheets

POSITIONING MEMBER AND IMAGE FORMING APPARATUS

TECHNICAL FIELD

The present invention relates to a positioning member and an image forming apparatus including the positioning member. As this image forming apparatus, it is possible to cite, for example, a copying machine, a printer, a facsimile machine or a multi-function machine having a plurality of functions of these machines.

BACKGROUND ART

Conventionally, in an electrophotographic image forming apparatus, a toner image is formed on a recording material (sheet) using an electrophotographic process and is fixed on the recording material by a fixing apparatus (fixing device). In such an image forming apparatus, it is preferable that mounting of the fixing device to a main assembly framework (main assembly frame) with high accuracy.

Therefore, in an apparatus described in Japanese Laid-Open Patent Application 2005-292612, a projected bar of a position adjusting member is inserted into a hole of a fixing device via an elongated hole of a position adjusting plate temporarily fixed to a main assembly frame and then the position adjusting plate is moved and a position of the fixing device is adjusted. Then, when positional adjustment is completed, the position adjusting member and the position adjusting plate are fastened to the main assembly frame with a screw, so that the fixing device is fixed to the main assembly frame.

However, in the case of a constitution described in Japanese Laid-Open Patent Application 2005-292612, there is a need to perform a position adjusting step when the fixing device is assembled, so that the step constitutes an obstacle to shortening of a time required for a manufacturing (assembling) step of the image forming apparatus.

However, after the fixing device is assembled with the main assembly frame, for example, the image forming apparatus is installed in an inclined place or the image forming apparatus is subjected to impact (shock) during use thereof, so that there is a liability that a situation that the main assembly frame is distorted generates. In the case where such a situation generates, there is a possibility that a relative positional relationship between the fixing device and another device (for example, a transfer device) is broken, and therefore it is desirable that the positional adjustment is made enable after the fixing device is assembled.

SUMMARY OF THE INVENTION

According to the present invention, there is provided a positioning member configured to be fixed to a main assembly frame of an image forming apparatus and configured to position a fixing device, comprising:

a mounting portion configured to mount one end of the fixing device with respect to a first direction substantially parallel to a longitudinal direction of the fixing device;

a first projected portion configured to be inserted into a first hole of the main assembly frame, wherein the first projected portion has a shape that the first projected portion is substantially immovable relative to the main assembly frame in a second direction substantially parallel to the first direction and is movable relative to the main assembly frame in a third direction substantially perpendicular to the first direction and the second direction;

a second projected portion configured to be inserted into a second hole of the main assembly frame, wherein the second projected portion has a shape that the second projected portion is substantially immovable relative to the main assembly frame in the second direction substantially parallel to the first direction and is movable relative to the main assembly frame in the third direction; and a third projected portion configured to be inserted into a third hole of the main assembly frame, wherein the third projected portion has a shape that the third projected portion is substantially immovable relative to the main assembly frame in the third direction substantially parallel to the first direction and is movable relative to the main assembly frame in the second direction;

wherein the third projected portion includes a snap-off facilitating portion which facilitates to snap off in order to permit movement of the positioning member relative to the main assembly frame in the third direction.

EMBODIMENT FOR CARRYING OUT THE INVENTION

Figure 1:
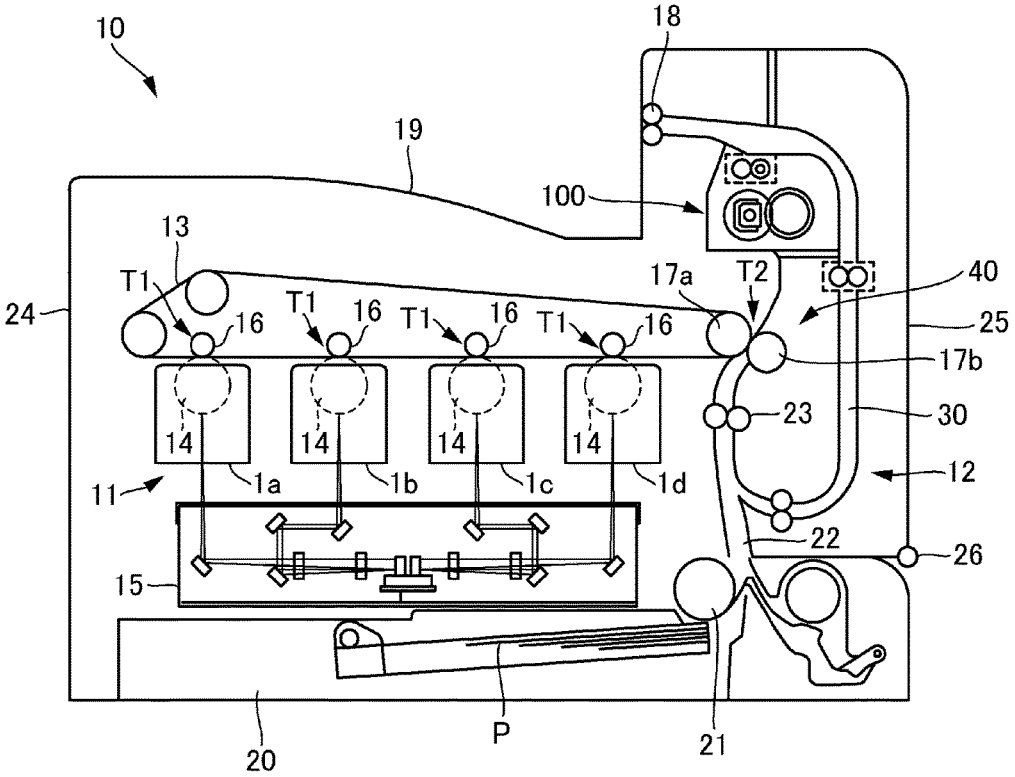
FIG. 1 is a schematic sectional view of an image forming apparatus.

An embodiment of the present invention will be described using FIG. 1 to FIG. 8. First, a schematic structure of an image forming apparatus in this embodiment will be described using FIG. 1.

[Image Forming Apparatus]

An image forming apparatus 10 in this embodiment is a full-color printer employing an electrophotographic type. Such an image forming apparatus 10 includes an image forming portion (image forming device) 11 for forming a toner image and a recording material feeding portion 12 for feeding a recording material for transferring thereon the toner image formed by the image forming portion 11. Incidentally, as the recording material, it is possible to cite, for example, a transfer sheet, an electrofax sheet, electrostatic recording paper, an OHP sheet, printing paper, format paper, and so on. The image forming portion 11 has a constitution of a so-called tandem type in which a plurality of image forming stations 1*a*, 1*b*, 1*c*, 1*d* are arranged in a traveling direction of an intermediary transfer belt 13. At the image forming stations 1*a*, 1*b*, 1*c*, 1*d*, toner images of yellow, magenta, cyan, black, are formed, respectively. In the case of this embodiment, each of the respective image forming stations 1*a*, 1*b*, 1*c*, 1*d* is constituted by a process cartridge.

At each of the image forming stations, the toner image is formed in the following manner. First, a surface of a photosensitive drum 14 is electrically charged by a charging device such as a charging roller, and the charged surface of the photosensitive drum 14 is exposed by an exposure device 15 to light depending on image information by a laser or the like, so that an electrostatic latent image is formed. Then, the electrostatic latent image is developed with a toner by a developing device, so that the toner image is formed on the surface of the photosensitive drum 14.

The toner images formed on the surfaces of the photosensitive drums 14 of the respective image forming stations are successively transferred superposedly on the intermediary transfer belt 13 at primary transfer portions T1, so that a full-color toner image is formed on the intermediary transfer belt 13. At the primary transfer portion T1, a primary transfer roller 16 as a primary transfer portion disposed opposed to the photosensitive drum 14 while sandwiching the intermediary transfer belt 13 therebetween. Then, by applying a primary transfer bias to between the primary transfer roller 16 and the photosensitive drum 14, the toner image on the photosensitive drum 14 is transferred onto the intermediary transfer belt 13.

The toner images on the intermediary transfer belt 13 are transferred onto a recording material P feed by a recording material feeding portion 12, at a secondary transfer portion T2. At the secondary transfer portion T2, an inner secondary transfer roller 17*a* and an outer secondary transfer roller 17*b* which are provided opposed to each other while sandwiching the intermediary transfer belt 13 therebetween are disposed. Then, by applying a secondary transfer bias to between the inner secondary transfer roller 17*a* and the outer secondary transfer roller 17*b*, the toner images on the intermediary transfer belt 13 are transferred onto the recording material P. In this embodiment, these intermediary transfer belt 13, inner secondary transfer roller 17*a* and outer secondary transfer roller 17*b* constitute a transfer device 40. The recording material P on which the toner images are transferred by the transfer device 40 is heated and pressed by a fixing apparatus (fixing device) 100 as a heating device, so that the toner images are subjected to a fixing process. Details of the fixing device 100 will be described later. The recording material P on which the toner images are fixed is discharged onto a discharge tray 19 by a discharging roller 19.

The recording material feeding portion 12 is constituted by a plurality of feeding rollers, and the recording material P accommodated in a cassette 20 is picked up by a pick-up roller 21 and is fed to a feeding path 22. The recording material P fed to the feeding path 22 is fed to the secondary transfer portion T2 by a registration roller pair 23 by being timed to the tone images formed on the image forming portion 11. Further, the recording material P discharged from the fixing device 100 is reversed for effecting double-side printing and is fed to a reverse feeding path 30 in addition to the discharge onto the discharge tray 19 as described above. The recording material P fed through the reverse feeding path 22 merges with the feeding path 22 and is fed to the secondary transfer portion T2 similarly as described above.

Further, in the case of this embodiment, on an apparatus main assembly 24 in which the above-described various devices are disposed, an openable door 25 is provided so as to open and close freely. The openable door 25 is provided rotatably about a rotation shaft 26 on a side where the feeding path 22 and the fixing device 100 are disposed. Then, by opening the openable door 25, the fixing device 100 and the feeding path 22 are exposed, so that mounting and demounting of the fixing device 100 and removal of a jammed recording material become possible. For this reason, the fixing device 100 is provided so as to be detachably mountable to the apparatus main assembly 24. A one-side roller of a feeding roller pair such as the registration roller pair 23 disposed in the feeding path 22, and the outer secondary transfer roller 17*b* constituting the secondary transfer portion T2 is provided on the openable door 25 side. Further, when the openable door 25 is opened, these rollers are spaced from the opposing rollers and the intermediary transfer belt 13.

[Fixing Device]

Figure 2:
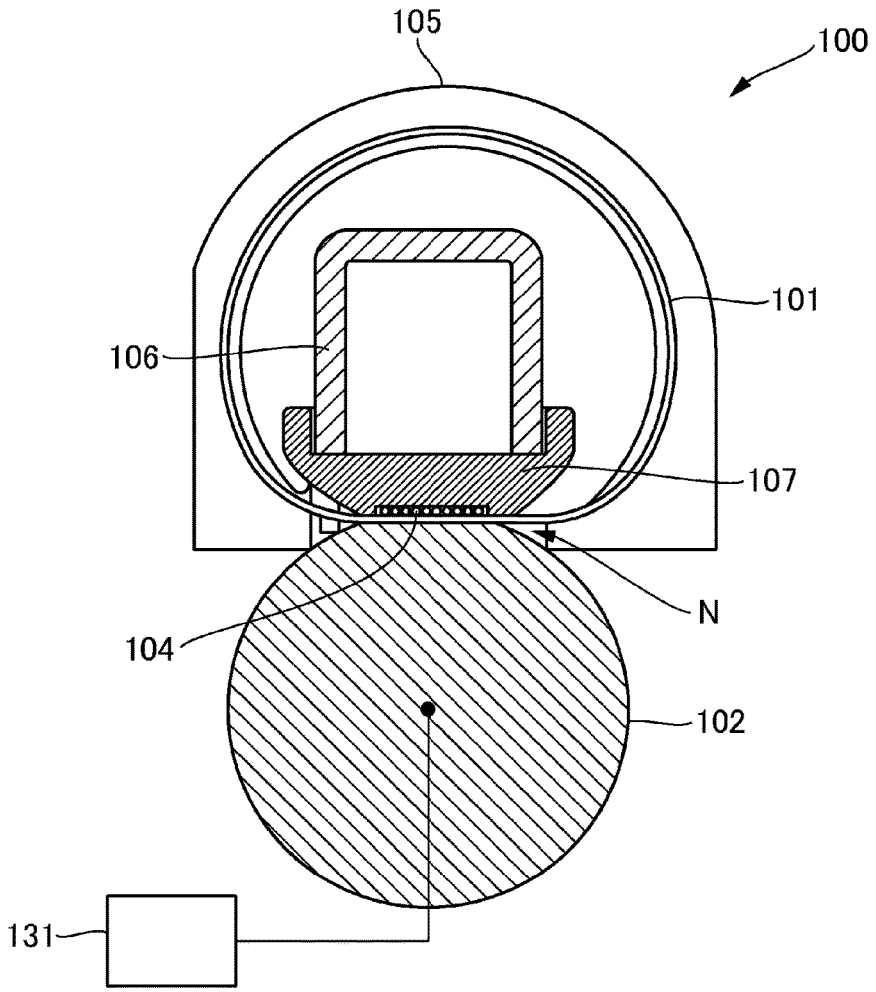
FIG. 2 is a schematic sectional view of a fixing device.

Next, details of the fixing device 100 as an heating apparatus (device) in this embodiment will be described using FIG. 2. The fixing device 100 includes, as a pair of rotatable members, a fixing film 101 and an opposite roller 102. Between these fixing film 101 and opposite roller 102, a nip (portion) N through which the recording material is nipped and fed is formed, and the toner images formed on the recording material passing through the nip N are heated and pressed by a heater 104 as a heating source, so that the fixing process is performed.

The fixing film 101 is a cylindrical heat-resistant member obtained by forming an elastic layer on a base layer of a cylindrical thin metal, and is loosely fitted in locus-regulating members 105 disposed at both end portions of the fixing film 101. With respect to such a fixing film 101, in order to improve a quick start property by making a thermal capacity mall, a film thickness is made 100 μm or less, preferably 20 μm or more and 50 μm or less. The fixing film 101 may also be a film including a base layer formed of metal such as SUS or may also be a single-layer film such as PTFE, PFA or FEP which have a heat-resistant property. Or, the fixing film 101 may also be a composite-layer film including a base layer of polyimide, polyamideimide, PEEK, PES, PPS or the like and a coating or coated layer of PTFE, PFA, FEP or the like on an outer peripheral surface of the base layer.

The opposite roller 102 is constituted by a core metal consisting of metal such as iron and a heat-resistant elastic material layer, molded and coated concentrically integrally about the core metal, formed of a silicone rubber, a fluorine-containing rubber or a fluorine-containing resin, and a parting layer is provided as a surface layer. For example, as a material for the parting layer, it is possible to select a material, having a good parting property and a good heat-resistant property, such as a fluorine-containing resin, a silicone resin, a fluorine-silicon rubber, a fluorine-containing rubber or a silicone rubber. At both end portions of the core metal, unshown pressing member supporting members consisting at a heat-resistant resin such as PEEK, PPS or a liquid crystal polymer are mounted and rotatably supported. Further, the opposite roller 102 is driven by a motor 131, as a driving source, provided in the apparatus main assembly 24. The fixing film 101 is rotated by rotationally driving the opposite roller 102, and feeds the recording material nipped in the nip N.

As described above, the locus-regulating members 105 fitted in the fixing film 101 at the both end portions of the fixing film 101 are members consisting of PET, PPS, LCP or the like which is the heat-resistant resin. Such a locus-regulating member 105 is movably supported by a side plate of the fixing device 100, and not only rotatably supports the fixing film 101 but also is disposed in a casing of the fixing device 100. Then, the locus-regulating member 105 not only guides rotation of the fixing film 101 but also functions as an abutting portion of the fixing film 101 in a longitudinal direction (direction crossing a recording material feeding direction at the nip N).

Inside the fixing film 101, a stay 106 is disposed along the longitudinal direction, and both end portions of the stay 106 are supported by the locus-regulating members 105. Such a stay 106 is a member principally consisting of a metal such as iron or SUS. Further, on an opposite roller 102 side of the stay 106, a press-contact member 107 is disposed. Further, by pressing the stay 106 against the press-contact member 107 made by a relatively soft resin, the press-contact member 107 is caused to have a strength with respect to the longitudinal direction (direction crossing the recording material feeding direction at the nip N) and the press-contact member 17 is rectified.

The press-contact member 107 is a heat-resistant and heat-insulating member having a substantially semi-circular shape in cross-section. For example, the press-contact member 107 is formed of a material, having a good insulating property and a good heat-resistant property, such as a phenolic resin, a polyimide resin, a polyamide resin, a polyamideimide resin, PEEK resin, PES resin, PPS resin, PFA resin, PTFE resin or LCP resin. Further, the press-contact member 107 performs functions of backing-up the fixing film 101, being press-contacted against the fixing film 101 toward the opposite roller 102 and realizing feeding stability of the fixing film 101 during rotation.

A ceramic heater (herein after referred to as a heater) 104 as a heating source is supported by the press-contact member 107. The heater 104 is engaged in a groove formed on a surface of the press-contact member 107 on the nip N side along the longitudinal direction and is supported. The heater 104 includes, as a basic structure, an elongated thin plate-like ceramic substrate and an electric power supplying heat generating resistor layer, and is a low thermal capacitance heater increasing in temperature with an abrupt rising characteristic as a whole by electric power supply to the heat generating resistor layer.

Figure 3:
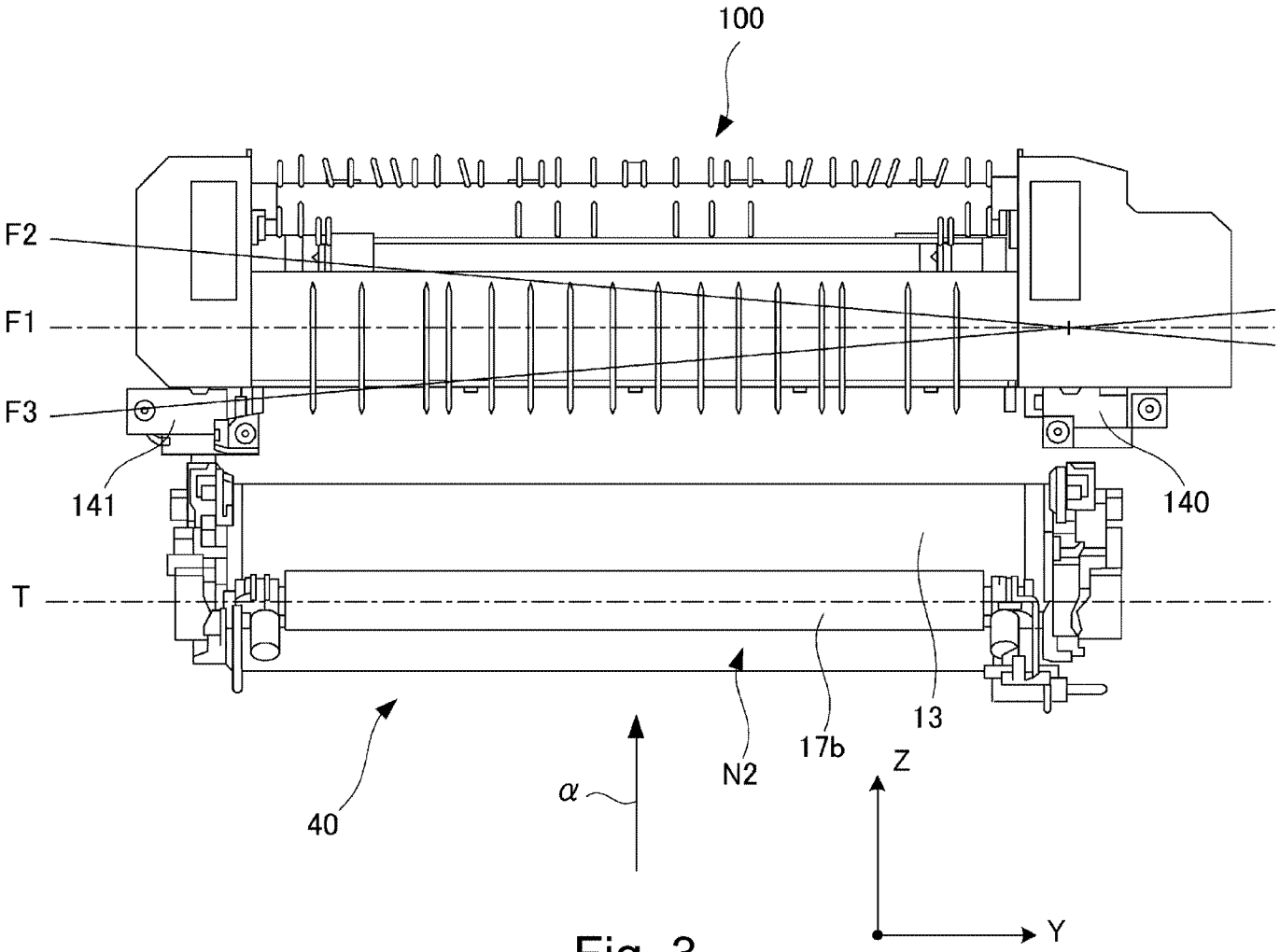
FIG. 3 is a schematic view for illustrating parallelism between the fixing device and a transfer device.

The fixing device 100 constituted as described above ensures parallelism with the transfer device 40 as shown in FIG. 3 when the fixing device 100 is mounted in the apparatus main assembly 24. That is, the recording material fed as shown by an arrow a is nipped and fed at a secondary transfer nip N2, of the transfer device 40, between the intermediary transfer belt 13 and the outer secondary transfer roller 17*b*, so that the toner images are transferred. Then, the recording material on which the toner images are transferred is nipped and fed at the nip (fixing nip) N of the fixing device 100.

At this time, in the case where the parallelism between the fixing device 100 and the transfer device 40 is deviated, a direction in which the recording material is fed at the secondary transfer nip N2 and a direction in which the recording material is fed at the fixing nip N do not coincide with each other. For this reason, there is a possibility that creases generate on the recording material or that the recording material is fed in a twisted state. Accordingly, in order to cause the respective feeding directions to coincide with each other, the parallelism between the fixing device 100 and the transfer device 40 is ensured. Specifically, a direction (chain line F1) perpendicular to the feeding direction in which the recording material is fed at the fixing nip N and a direction (chain line T) perpendicular to the feeding direction in which the recording material is fed at the secondary transfer nip N2 are made parallel to each other. For this reason, in this embodiment, as shown in FIG. 4, the fixing device 100 is disposed by positioning the fixing device 100 relative to the main assembly frame of the apparatus main assembly 24.

[Positioning of Fixing Device]

Next, positioning of such a fixing device 100 will be described using FIG. 3 to FIG. 11. In the following, a positioning device 200 of a unit for positioning the fixing device 100, as a unit to be positioned relative to a main assembly framework (main assembly frame) 201, with respect to an up-down (vertical) direction in FIG. 1, i.e., a predetermined direction (arrow Z direction shown in FIG. 3 and later, hereinafter referred to as "Z direction") which is a gravitational direction (direction of gravity) will be described. Incidentally, X direction and Y direction (which is a direction substantially parallel to a longitudinal direction of the fixing device and also a direction substantially parallel to an axial direction of the opposite roller 102 being a rotatable member and which is a direction substantially parallel to the horizontal direction) which are shown in FIG. 5 and the like are directions each substantially perpendicular to the Z direction. For example, when the fixing device 100 is mounted in the apparatus main assembly 24, the positioning device 200 is positioned by connecting a member provided on the fixing device 100 and a member provided in the apparatus main assembly 24.

Figure 4:
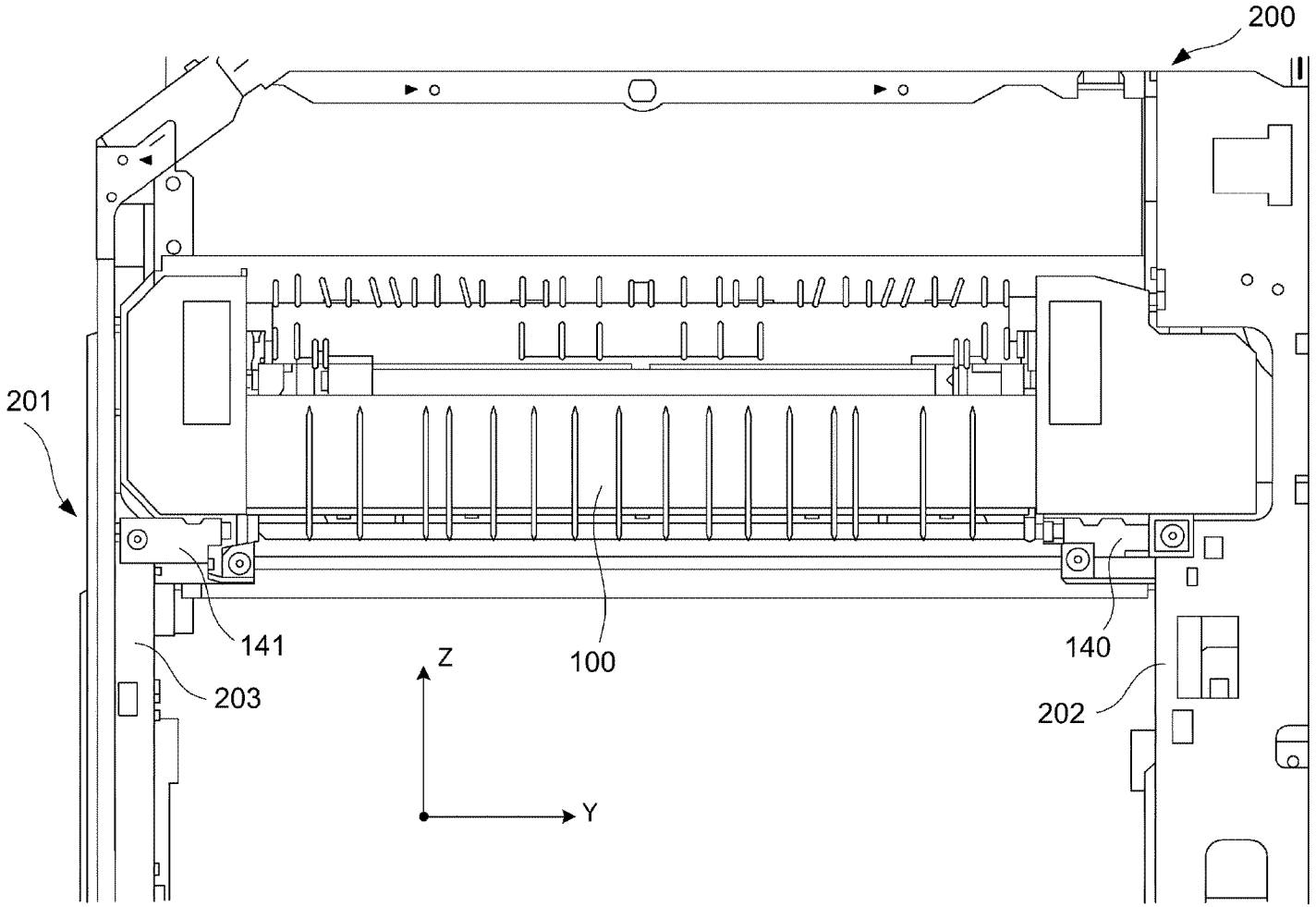
FIG. 4 is a front view showing a state in which the fixing device is mounted in a main assembly frame.
Figure 5:
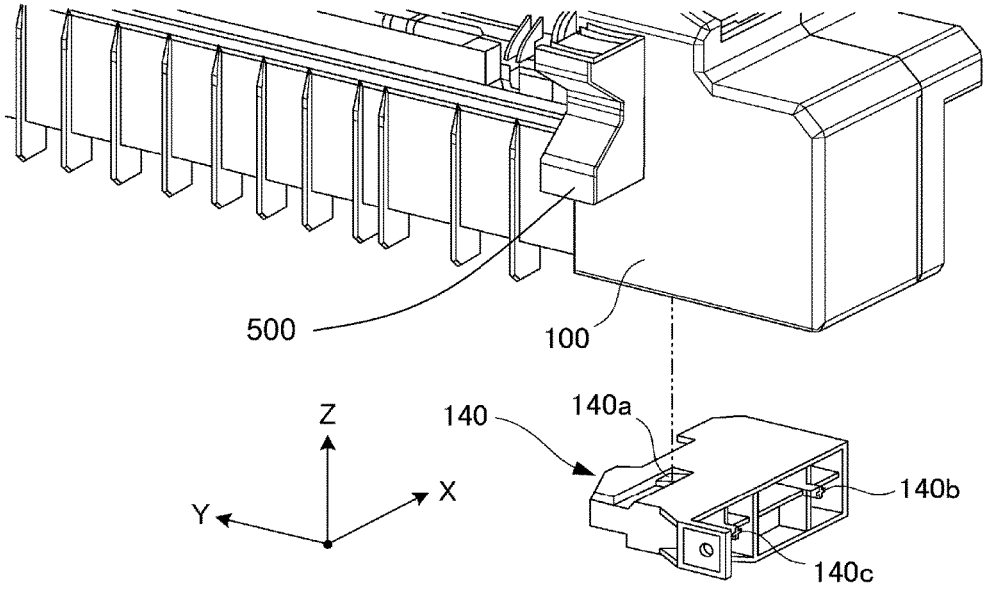
FIG. 5 is an exploded perspective view of a part of the fixing device and a first positioning member for effecting positioning of the fixing device on one side with respect to a widthwise direction.

The positioning member 200 includes, as shown in FIG. 4, the main assembly frame 201 made of metal, a first positioning member (another positioning member) 140 and a second positioning member 141 which are made of a resin material. The main assembly frame 201 is frame provided in the apparatus main assembly 24 and supports various devices (units) such as the fixing device 100 and the transfer device 40. In this embodiment, the main assembly frame 201 includes supporting plate portions 202 and 203 disposed with respect to the Z direction on both sides of the fixing device 100 with respect to a widthwise direction (a longitudinal direction of the fixing device and the arrow Y direction (horizontal direction), shown in FIG. 3 and later, which is a direction perpendicular to the feeding direction of the recording material and which is a direction perpendicular to the Z direction (gravitational direction). The first positioning member 140 and the second positioning member 141 support both end portions, respectively, of the fixing device 100 with respect to the widthwise direction. Then, positioning of the fixing device 100 relative to the main assembly frame 201 with respect to the Z direction (gravitational direction) is effected.

That is, the first positioning member 140 is disposed singly on the supporting plate portion 202 on one side (right side of FIG. 4) of the main assembly frame 201, and as shown in FIG. 5, one end of the fixing device 100 with respect to the widthwise direction is mounted thereon, so that the first positioning member 140 supports one side of the fixing device 100 with respect to the widthwise direction and effects positioning of the fixing device 100 with respect to the Z direction. For this reason, on an upper surface of the first positioning member 140, a positioning surface 140*a* as a mounting surface (mounting portion) on which the fixing device 100 is mounted is provided, and on this positioning surface 140*a*, one end of the fixing device 100 with respect to the longitudinal direction is mounted. At this positioning surface 140*a*, a recessed portion is formed and is constituted so that a boss portion capable of projecting from the bottom of the fixing device 100 downward enters this recessed portion. Further, this boss portion is constituted so as to be drawn back and retracted from the recessed portion by gripping a lever portion 500 (FIG. 5) of the fixing device 100, with the result that an interference state with the recessed portion is eliminated, so that demounting of the fixing device becomes possible.

Figure 6:
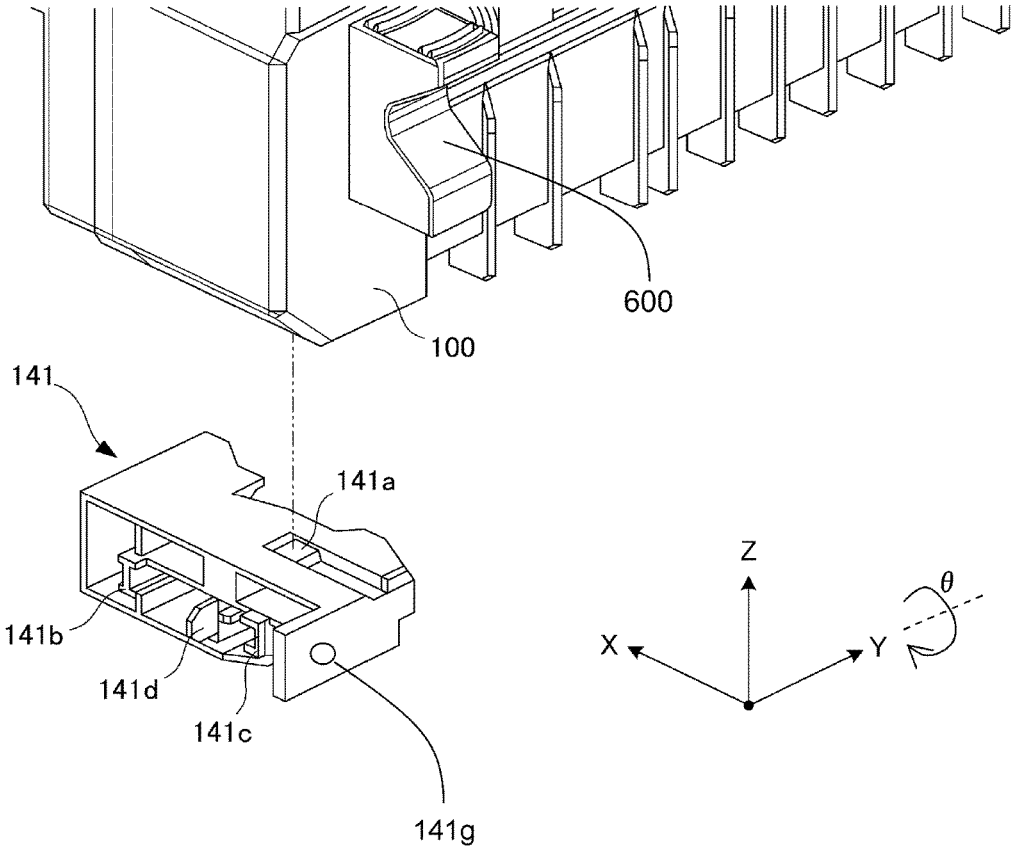
FIG. 6 is an exploded perspective view of a part of the fixing device and a second positioning member for effecting positioning of the fixing device on the other side with respect to the widthwise direction.
Figure 7:
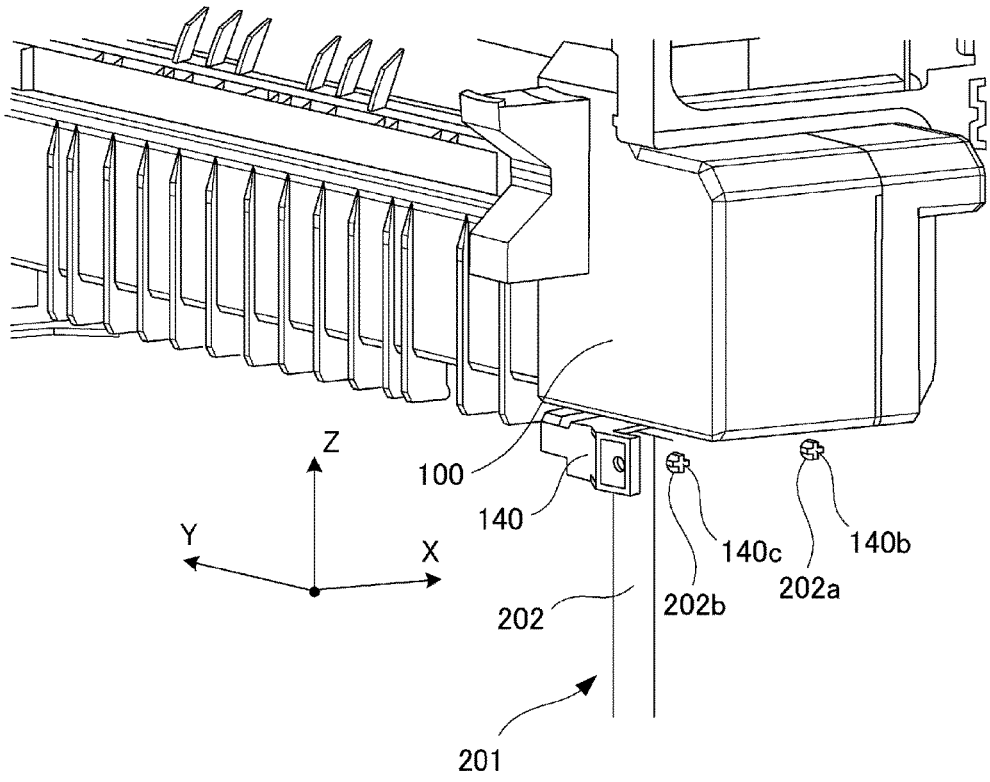
FIG. 7 is a perspective view showing a state in which the fixing device is fixed to the main assembly frame by the first positioning member on the one side with respect to the widthwise direction.

Further, the second positioning member 140 is disposed singly on the supporting plate portion 202 on the other side (left side of FIG. 4) of the main assembly frame 201, and as shown in FIG. 6, the other end of the fixing device 100 with respect to the widthwise direction is mounted thereon, so that the second positioning member 141 supports the other side of the fixing device 100 with respect to the widthwise direction and effects positioning of the fixing device 100 with respect to the Z direction. For this reason, on an upper surface of the second positioning member 141, a positioning surface 141*a* as a bearing surface for the fixing device 100 is provided, and on this positioning surface 141*a*, the other end of the fixing device 100 with respect to the longitudinal direction is mounted. At this positioning surface 141*a*, a recessed portion is formed and is constituted so that a boss portion capable of projecting from the bottom of the fixing device 100 downward can enter this recessed portion. Further, this boss portion is constituted so as to be drawn back by gripping a lever portion 600 (FIG. 6) of the fixing device 100, with the result that an interference state with the recessed portion is eliminated, so that demounting of the fixing device becomes possible.

[First Positioning Member]

Figure 8:
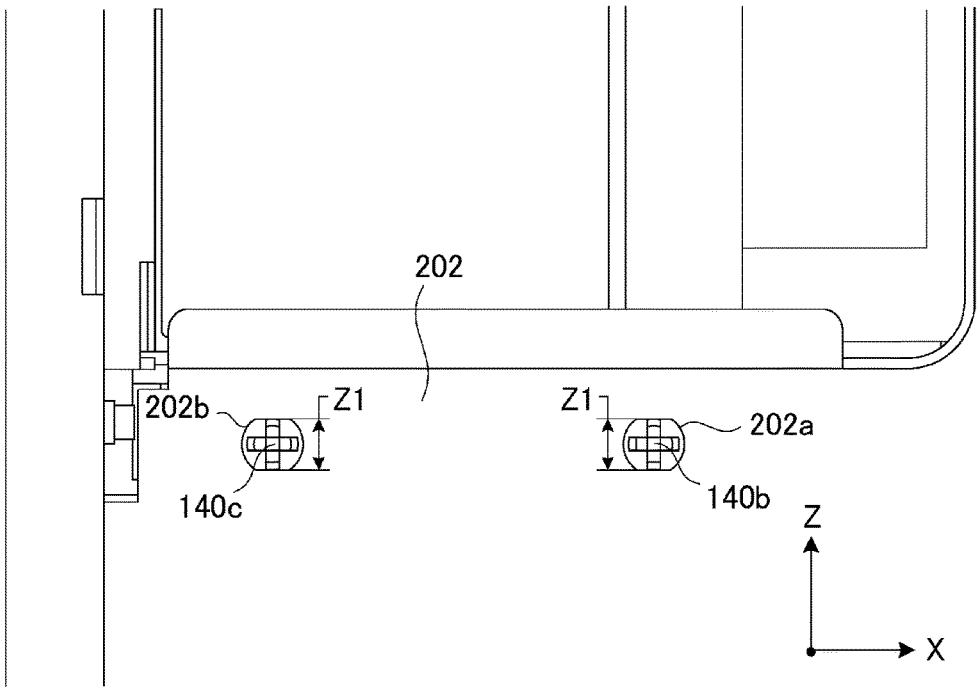
FIG. 8 is a side view showing a state in which the first positioning member is fixed to the main assembly frame.

On the first positioning member 140, as shown in FIG. 5, two projections 140*b*, 140*c* are formed, and as shown in FIG. 17, are inserted into positioning holes 202*a*, 202*b*, respectively, formed in the supporting plate portion 202 of the main assembly frame 201. The positioning holes 202*a*, 202*b* are made so that dimensions Z1 thereof with respect to the Z direction is substantially the same as dimensions Z of the projections 140*b*, 140*c*, respectively, as shown in FIG. 8, and the projections 140*b*, 140*c* are inserted into the positioning holes 202*a*, 202*b* and thus are engaged and fixed. The first positioning member 140 is thus engaged and fixed at two positions to the supporting plate portion 202 of the main assembly frame 201, and therefore is positioned so as to be immovable in the Z direction relative to the main assembly frame 201. Further, the first positioning member 140 is, different from the second positioning member 141 described later, constituted so that positional adjustment cannot be made relative to the main assembly frame.

[Second Positioning Member]

Figure 9:
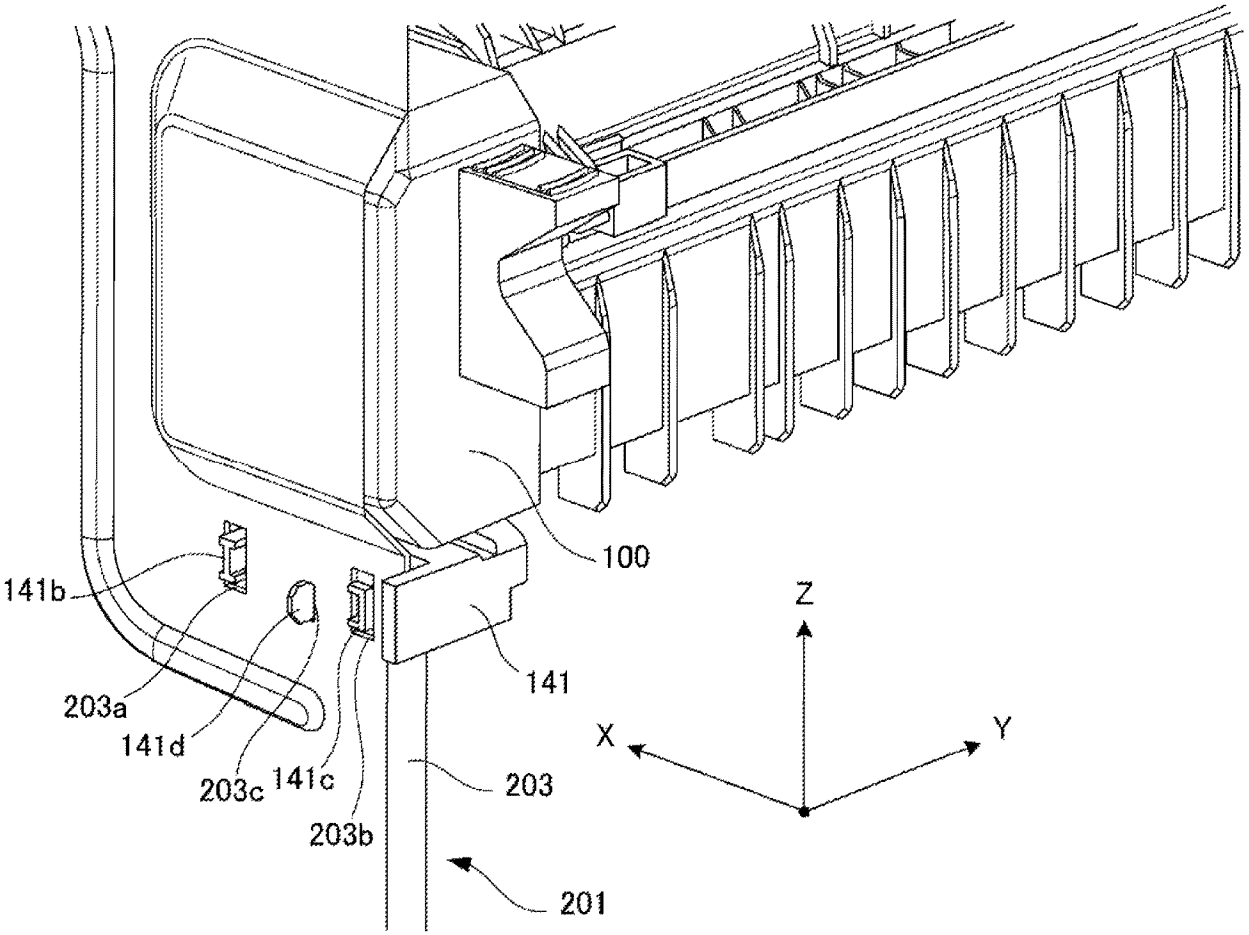
FIG. 9 is a perspective view showing a state in which the fixing device is fixed to the main assembly frame by the second positioning member on the other side with respect to the widthwise direction.

On the second positioning member 141, as shown in FIG. 6, a first projection 141*b*, a second projection 141*c* and a third projection 141*d* which are engaging portions are formed. The first projection 141*b* and the second projection 141*c* are spaced and disposed so as to sandwich the third projection 141*d* with respect to a direction substantially perpendicular to the Z direction and the Y direction, i.e., an arrow X direction shown in FIG. 3 and later (hereinafter referred to as "X direction"). Further, as shown in FIG. 9, the first projection 141*b* and the second projection 141*c* are inserted into holes 203*a*, 203*b* which are portions-to-be-engaged formed in the supporting plate portion 203 of the main assembly frame 201. Further, the third projection 141*d* is inserted into a hole 203*c* which is a portion-to-be-engaged formed in the supporting plate portion 203.

Figure 10:
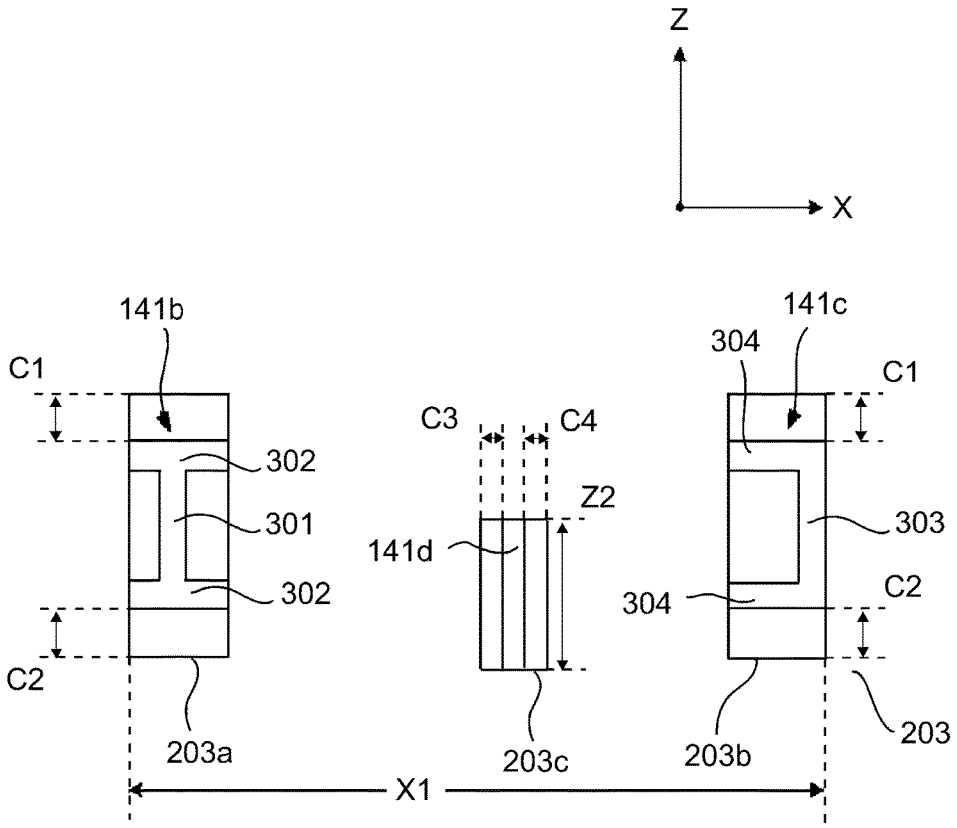
FIG. 10 is a side view showing a state in which the second positioning member is fixed to the main assembly frame.

The first projection 141*b* has, as shown in FIG. 10, a shape that X-direction rectilinear portions 302 are provided at both end portions, respectively, of a Z-direction rectilinear portion 301 parallel to the Z direction and extends in parallel to the X direction and on both sides of the Z-direction rectilinear portion 301 with respect to the X direction. The pair of X-direction rectilinear portions 302 are in the same position with respect to the X direction at both end surfaces thereof, and are chamfered at corners of a free end surface and both end surfaces of the first projection 141*b* with respect to a projection direction.

The second projection 141*c* has, as shown in FIG. 10, a shape that X-direction rectilinear portions 304 are provided at both end portions, respectively, of a Z-direction rectilinear portion 303 parallel to the Z direction and extends in substantially parallel to the X direction and on one side of the Z-direction rectilinear portion 303 with respect to the X direction. The pair of X-direction rectilinear portions 304 are in the same position with respect to the X direction at one end surface thereof, and are chamfered at a corner of a free end surface and the one end surface of the second projection 141*c* with respect to a projection direction. Further, the portions 304 are chamfered also at a corner of the free end surface and the other end surface of the Z-direction rectilinear portion 303 with respect to the projection direction.

The holes 203*a*, 203*b* into which the first projection 141*b* and the second projection 141*c* are inserted, respectively, are spaced and disposed with respect to the X direction, and each of the heaters 203*a*, 203*b* is long with respect to the Z direction and is formed in a rectangular shape that both end surfaces thereof with respect to the X direction are parallel to the Z direction. Further, the holes 203*a*, 203*b* are freely engageable with the first projection 141*b* and the second projection 141*c*, respectively. Further, dimensions of the holes 203*a*, 203*b* with respect to the Z direction are made larger than dimensions of the first projection 141*b* and the second projection 141*c*, respectively. Further, also dimensions of the holes 203*a*, 203*b* with respect to the X direction are made larger than dimensions of the first projection 141*b* and the second projection 141*c*, respectively.

Into the thus-constituted holes 203*a*, 203*b*, the first projection 141*b* and the second projection 141*c* are inserted, respectively, so that the holes 203*a*, 203*b* and the first projection 141*b* and the second projection 141*c* are engaged with each other, respectively. At this time, the chamfers formed on the first projection 141*b* and the second projection 141*c* guide entrance into the holes 203*a*, 203*b*. Further, as described later, in a state in which the third projection 141*c* and the hole 203*c* are engaged with each other, gaps (spacings) C1, C2 (FIG. 10) with respect to the Z direction are formed between the first projection 141*b* and the hole 203*a* and between the second projection 141*c* and the hole 203*b*, respectively. That is, the first projection 141*b* and the second projection 141*c* have a relationship (substantially immovable relationship relative to the main assembly frame 201) in which they are substantially fitted with the holes 203*a* and 203*b*, respectively, with respect to the X direction and have a relationship (movable relationship relative to the main assembly frame 201) in which they are loosely engaged with the holes 203*a* and 203*c*, respectively, with respect to the Z direction. Accordingly, the gaps C1, C2 exist on both sides with respect to the Z direction. For this reason, in this state, the holes 203*a*, 203*b* and the first projection 141*b* and the second projection 141*c* do not engage with each other with respect to the Z direction. Incidentally, the first projection 141*b* and the second projection 141*c* have a length relationship in which play to the extent that they can smoothly enter the holes 203*a* and 203*b*, respectively, with respect to the X direction is provided. That is, a constitution in which the lengths of the first projection 141*b* and the second projection 141*c* are slightly shorter than the lengths of the holes 203*a* and 203*b*, respectively, with respect to the X direction is employed.

Further, the first projection 141*b*, the second projection 141*c* and the holes 203*a*, 203*b* position the second positioning member 141 relative to the supporting plate portion 203 of the main assembly frame 201 with respect to the X direction by engaging with each other, respectively, with respect to the X direction. For this purpose, a width X1 between outside surfaces of the holes 203, 203*b* with respect to the X direction is made substantially equal to a width between outside surfaces of the first projection 141*b* and the second projection 141*c* with respect to the X direction. Further, by engaging the outside surfaces of the first projection 141*b* and the second projection 141*c* with the outside surfaces of the holes 203*a*, 203*b*, respectively, with respect to the X direction, the second positioning member 141 is positioned to the main assembly frame 201 with respect to the X direction. Accordingly, by providing two projections for effecting positioning with respect to the X direction, i.e., by providing the first projection 141*b* and the second projection 141*c*, the positioning member 141 is prevented from rotating in e direction (FIG. 6) relative to the main assembly frame 201. Further, the two projections performing the function of a rotation stopper for this positioning member 141, i.e., the first projection 141*b* and the second projection 141*c* are spaced and disposed with respect to the X direction (the third projection 141*d* is disposed therebetween), whereby a device is made so that the positioning member 141 is harder to rotate. Incidentally, a width between inside surfaces of the holes 203*a*, 203*b* with respect to the X direction may also be made substantially equal to a width between inside surfaces of the first projection 141*b* and the second projection 141*c* with respect to the X direction. Further, by engagement of the inside surfaces of the first projection 141*b* and the second projection 141*c* with respect to the X direction with the inside surfaces of the holes 203*a*, 203*b* with respect to the X direction, the second positioning member 141 may also be positioned to the main assembly frame 201 with respect to the X direction.

Figure 11:
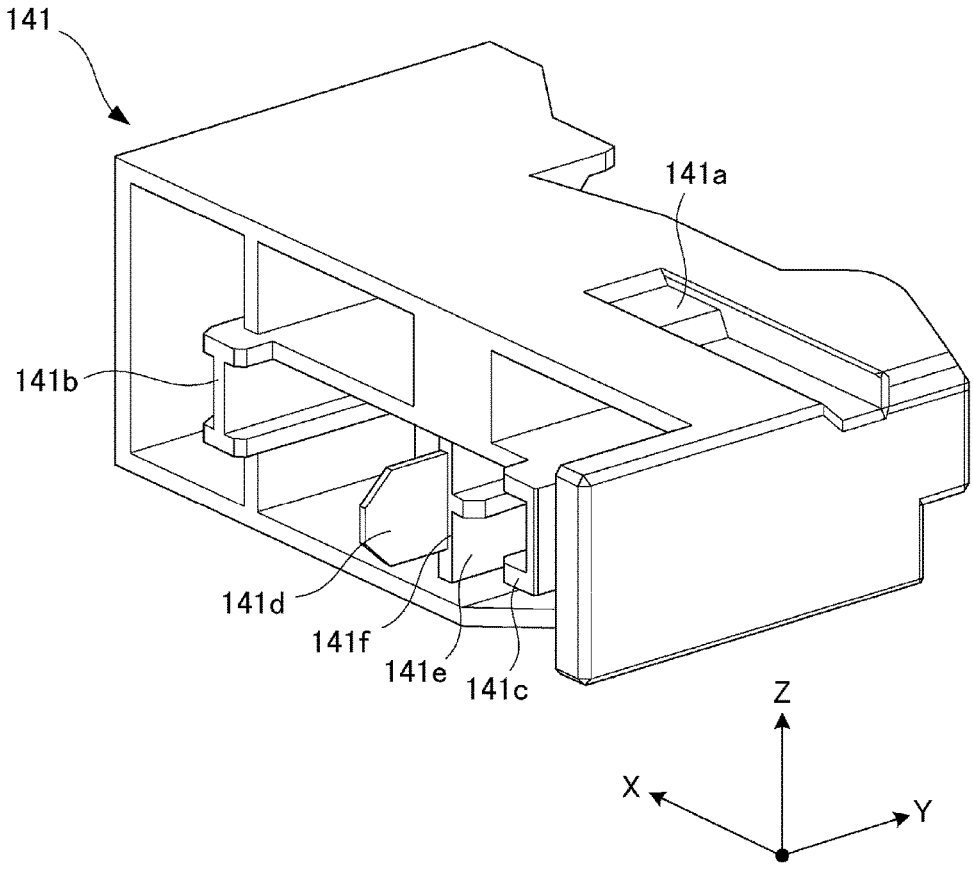
FIG. 11 is a perspective view of the second positioning member.

The third projection 141*d* has, as shown in FIG. 10 and FIG. 11, a rectangular plate shape (rib shape) in cross section in which a length with respect to the Z direction is longer than a length with respect to the X direction, and is formed so as to project in the Y direction from a main assembly portion 141*e* of the second positioning member 141. The third projection 141*d* and the main assembly portion 141*e* are continuous by a stepped portion 141*f*. The thus-constituted third projection 141*d* is, as described later, capable of being removed by being snapped off in the X direction at the stepped portion 141*f*. That is, the third projection 141*d* includes a snap-off facilitating portion (thin portion) where a thickness thereof with respect to the X direction is made thin to facilitate to snap off. In this embodiment, this stepped portion 141*f* performs the function as the snap-off facilitating portion.

Further, the corners of the free end surface of the third projection 141*d* and both side surfaces of the third projection 141*d* with respect to the Z direction are chamfered. The hole 203*c* into which the third projection 141*d* is to be inserted is formed in a rectangular shape long in the Z direction. Further, the hole 203*c* is freely engageable with the third projection 141*d*. When the third projection 141*d* enters the hole 203*c*, the third projection 141*d* is guided by the chamfers formed thereon.

The third projection 141*d* enters and engages with the hole 203*c*, so that the second positioning member 141 is positioned to the supporting plate portion 203 of the main assembly frame 201. For this purpose, a dimension Z2 of the hole 203*c* with respect to the Z direction is made substantially equal to a dimension of the third projection 141*d* with respect to the Z direction. Further, both side surfaces of the third projection 141*d* with respect to the Z direction and both side surfaces of the hole 203*c* are constituted so as to engage with each other. In other words, the third projection 141*d* engages with the hole 203*c* with respect to the Z direction.

On the other hand, a dimension of the third projection 141*d* with respect to the X direction is made smaller than a dimension of the hole 203*c* with respect to the X direction. Further, in a state in which the third projection 141*c* and the hole 203*c* are engaged with each other, gaps (spacings) C3, C4 (FIG. 10) with respect to the X direction are formed between the third projection 141*d* and the hole 203*c*, respectively. That is, the third projection 141*d* has a relationship (substantially immovable relationship relative to the main assembly frame 201) in which the third projection 141*d* is substantially fitted with the hole 203*c* with respect to the Z direction (gravitational direction) and has a relationship (movable relationship relative to the main assembly frame 201) in which the third projection 141*d* is loosely engaged with the hole 203*c* with respect to the X direction. Accordingly, the gaps C3, C4 exist on both sides with respect to the X direction. For this reason, in this state, the hole 203*c* and the third projection 141*d* do not engage with each other with respect to the X direction. Incidentally, the third projection 141*d* has a length relationship in which play to the extent that they can smoothly enter the hole 203*c* with respect to the Z direction is provided. That is, a constitution in which the lengths of the third projection 141*c* is slightly shorter than the length of the hole 203*c* with respect to the Z direction is employed.

Further, the third projection 141*d* is constituted so as to project from the hole 203*c* at least at the free end portion in a state in which the third projection 141*d* is engaged with the hole 203*c*. Further, in this state, the stepped portion 141*f* for causing the third projection 141*d* and the main assembly portion 141*e* to be continuous to each other is provided on the main assembly portion side than the hole 203*c*. By this, by gripping a free end of the third projection 141*d* projecting from the hole 203*c* and by applying a force in the X direction, so that the third projection 141*d* is snapped off at the stepped portion 141*f* and thus the third projection 141*d* can be removed so as to be disengaged from the hole 203*c*.

By mounting the fixing device 100 with the above-described relationships, the first positioning member 140 and the second positioning member 141 are positioned to the main assembly frame 201. For this reason, the fixing device 100 is supported by the first positioning member 140 and the second positioning member 141, so that the position of the fixing device 100 with respect to the Z direction is determined. At this time, the positions of the both end portions of the fixing device 100 with respect to the widthwise direction are determined by the first positioning member 140 and the second positioning member 141, respectively, and therefore also parallelism of the fixing device 100 with the transfer device 40 is determined.

Thus, in this embodiment, the two positioning members are mounted so that there is no need to effect particular adjustment during assembling of the fixing device. For that reason, positional accuracy of the holes formed in the main assembly frame is ensured, and also positional accuracy of the projections disposed on the positioning members 140, 141 is ensured. However, after the assembling, in the case where if the adjustment of the parallelism of the fixing device is needed, a device is made so that the adjustment is enabled by moving the second positioning member 141 relative to the main assembly frame. That is, the second positioning member 141 has a constitution in which although the position of the fixing device 100 is regularized by mounting the second positioning member 141 to the main assembly frame 201 with no particular adjustment, the third projection 141*d* is made removable easily by being formed as described above in order to enable to adjustment of the parallelism of the fixing device 100 for the event of an emergency.

That is, the third projection 141*d* is, as shown in the above-described FIG. 11, formed by a rib shape long in the Z direction relative to the X direction. This is because the second positioning member 141 has a constitution in which the second positioning member 141 supports the fixing device 100 with respect to the gravitational direction and therefore there is a possibility that a weight of the fixing device 100 is exerted on the third projection 141*d* and thus there is a need to support the fixing device 100. By forming the third projection 141*d* in the rib shape long in the Z direction, even in the case where the weight is exerted, deformation, breakage and the like of the third projection 141*d* are prevented, so that it is possible to prevent a fluctuation or the like in positions of the second positioning member 141 and the fixing device 100. The length of this third projection 141*d* with respect to the Z direction may desirably be 5 mm or more.

Further, the third projection 141*d* is made short in length with respect to the X direction relative to the Z direction, so that the third projection 141*d* facilitates to snap off when the force is applied in the X direction as described above. By snapping off and removing the third projection 141*d*, the second positioning member 141 is positionally adjustable with respect to the Z direction, with the result that the adjustment of the parallelism of the fixing device 100 with the transfer device 40 becomes possible. In order to facilitate the third projection 141*d* to snap off in the X direction, the width of the third projection 141*d* with respect to the X direction may desirably be 1.2 mm or less.

Further, the third projection 141*d* has a shape capable of facilitating to snap off at a desired position when the force is applied toward the X direction. For this purpose, as described above, the stepped portion 141*f* is provided in the neighborhood of a base portion of the third projection 141*d*, so that a shape (thin) that the main assembly portion 141*e* constituting the base portion is thick and the third projection 141*d* which is a free end-side portion is thin is formed. By forming such a shape, when the force is applied to the third projection 141*d*, a stress concentrates at the stepped portion 141*f*, so that the third projection 141*d* becomes easy to be removed by snapping off only the narrowed free end portion. That is, by applying the force in the X direction, the stress concentrates in the neighborhood of the stepped portion 141*f* where the third projection 141*d* thinner than the main assembly portion 141*e* is continuous to the main assembly portion 141*e*, so that the third projection 141*d* is snapped off at the stepped portion 141*f* or in the neighborhood thereof. Accordingly, in the case of this embodiment, the neighborhood of the stepped portion 141*f* of the thin third projection 141*d* constitutes the snap-off facilitating portion. Incidentally, in this embodiment, the stepped portion 141*f* is thus formed, so that the third projection 141*d* facilitates to snap off with respect to the X direction (to have the snap-off facilitating portion), but the present invention is not limited to this if a shape which facilitates to snap off in the X direction is formed. In summary, the snap-off facilitating portion may only be required to have a snap-off facilitating shape, such as a thin portion, thinner than another portion, and for example, such a constitution that a recessed shape is provided with respect to the X direction in the neighborhood of the base portion and the stress is concentrated at the recessed-shape portion may also be employed.

On the other hand, the third projection 141*d* has the shape which facilitates to snap off when a load is exerted in the X direction, but in a situation in which the adjustment is not effected, the third projection 141*d* is prevented from unintentionally snapping off by being subjected to the force with respect to the X direction. That is, as described above, the third projection 141*d* and the hole 203*c* have the gaps C3, C4 with respect to the X direction. By this, in ordinal use in which the adjustment is not made, the third projection 141*d* is prevented from being subjected to the load with respect to the X direction, so that unintentional snapping-off of the third projection 141*d* or the like is prevented.

Figure 12:
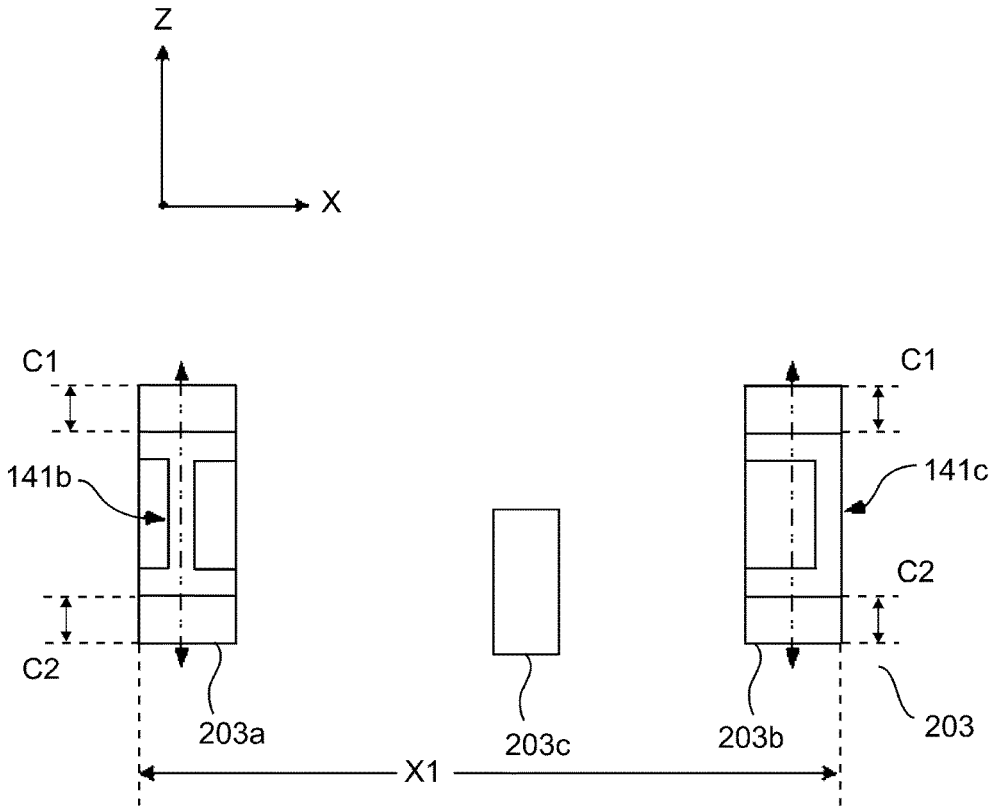
FIG. 12 is a side view showing a state in which a third projection of the second positioning member is removed and the second positioning member is movable relative to the main assembly frame.

Subsequently, the case where the third projection 141*d* snaps off in order to effect the adjustment of the fixing device 100 will be described. The second positioning member 141 is movable in a predetermined Z direction, in a state in which the second positioning member 141 is positioned to the main assembly frame 201 with respect to the X direction, by removing the third projection 141*d*. In the case where the third projection 141*d* is snapped off and removed, as shown in FIG. 12, a state in which the third projection 141*d* does not exist in the hole 203*c* is formed. For this reason, the second positioning member 141 has no positioning portion with respect to the Z direction. In such a case, in the hole 203*a* and the hole 203*b*, the first projection 141*b* and the second projection 141*c* are movable in the Z direction shown by chain lines in the figure on the basis of engagement of the outside surfaces of the first projection 141*b* and the second projection 141*c* with the outside surfaces of the hole 203*a* and the hole 203*b*. Further, in a state in which the second positioning member 141 is positioned with respect to the X direction, the second positioning member 141 can be slid and moved in the Z direction.

At this time, as described above, the stepped portion 141*f* provided in the neighborhood of the base portion of the third projection 141*d* is provided at a position retracted on the main assembly portion 141*e* side than the hole 203*c*. For this reason, the snap-off portion of the third projection 141*d* can be set at the retracted position from the main assembly frame 201. By this, when the third projection 141*d* is snapped off and the second positioning member 141 is intended to be fluctuated, it is possible to prevent that a remaining portion of the third projection 141*d* without being snapped off is caught in the hole 203*c* or the like to constitute an obstacle to movement.

When the second positioning member 141 is moved in the Z direction, also the fixing device 100 supported by the second positioning member 141 is moved. The first positioning member 140 supporting the fixing device 100 on one side with respect to the widthwise direction is positioned with respect to the Z direction as described above, and a position thereof is unchanged. For this reason, the second positioning member 141 is, in the case where the third projection 141*d* is removed, swingable in the Z direction on the other side with respect to the widthwise direction of the fixing device 100 about, as a fulcrum, the widthwise one side of the fixing device 100 supported by the first positioning member 140. That is, only one of the widthwise sides of the fixing device 100 moves in the Z direction.

For example, when the second positioning member 141 is raised toward an upper side (one side with respect to the Z direction), with the raising, the second positioning member 141 side of the fixing device 100 is raised. Then, as shown in FIG. 3, a direction (fixing nip line) perpendicular to the feeding direction in which the recording material is fed in the fixing nip N of the fixing device 100 is moved from the chain line F1 to a solid line F2. By this, an angle of the fixing nip line with respect to a direction (transfer nip line) T perpendicular to the feeding direction in which the recording material is fed in the secondary transfer nip N2 of the transfer device 40 fluctuates. On the other hand, also when the second positioning member 141 is lowered toward a lower side (the other side with respect to the Z direction), similarly, the fixing nip line fluctuates from the chain line F1 to a solid line F3.

Thus, when the second positioning member 141 is moved in the Z direction and the position of the fixing device 100 is adjusted to a desired position, the second positioning member 141 is fixed to the main assembly frame 201 by a fastening member such as a screw. Specifically, the positioning member 141 is fixed so as to be immovable relative to the main assembly frame 201 by the screw through a hole 141*e* (FIG. 6) for fastening. If the adjustment of the parallelism of the fixing device 100 is needed, by loosening this screw, the positioning member 141 is demounted from the main assembly frame 201. Then, the third projection 141*d* is snapped off and after the positional adjustment (Z-direction adjustment) of the positioning member 141 relative to the main assembly frame 201 is effected, the positioning member 141 is fixed again to the main assembly frame 201 with the screw. Incidentally, in this embodiment, in order to mount and demount the fixing device 100 relative to the apparatus main assembly 24, the second positioning member 141 and the fixing device 100 are not fixed to each other, but in the case of a constitution in which the mounting and the demounting are not made, the fixing device 100 and the second positioning member 141 may also be fixed to each other.

In the case of this embodiment, the third projection 141*d* and the hole 203*c* are engaged with each other in such a manner, so that the second positioning member 141 is positioned parallel to the main assembly frame 201 with respect to the Z direction. The second positioning member 141 effects the positioning of the fixing device 100 while supporting the fixing device 100, and therefore during the assembling of the fixing device 100, can effect the positioning of the fixing device 100 to the main assembly frame 201 without performing the positional adjustment.

Further, by removing the third projection 141*d*, the second positioning member 141 is movable in the Z direction, the positional adjustment of the fixing device 100 with respect to the Z direction can be effected later as described above. At this time, positional relationships of the first projection 141*b* and the second projection 141*c* with the hole 203*a* and the hole 203*b*, respectively, are unchanged, and therefore a relative positional relationship of the second positioning member 141 with the main assembly frame 201 with respect to the X direction and the e direction is unchanged. For this reason, a person performing an adjusting operation can easily adjust the second positioning member 141 with respect to the Z direction without concern for deviation of the second positioning member 141 in the X direction and tilting of the second positioning member 141 with respect to the Z direction.

Other Embodiment

In the above-described embodiment, a mechanism for positioning and adjustment relating to the parallelism of the fixing device 100 and a mechanism for the adjustment were described. However, the present invention is similarly applicable to, in addition to this, also a mechanism for positioning and adjustment relating to the parallelism of the feeding unit for feeding the recording material (sheet).

Further, in the above-described embodiment, the positioning of the second positioning member 141 with respect to the X direction is made by the engagement of the outside surfaces of the first projection 141*b* and the second projection 141*c* with the outside surfaces of the two holes 203*a*, 203*b*. However, in the present invention, for example, a constitution in which a rectangular projection having a length with respect to one of the Z directions and one of the X directions and its corresponding hole are engaged with each other may also be employed. Further, the projection provided on the second positioning member 141 may also be engaged with a wall portion provided on the main assembly frame 201 to realize the positioning. Further, the second positioning member 141 itself is caused to enter the recessed portion provided on the main assembly frame 201, so that the positioning of the second positioning member 141 with respect to the X direction may also be effected by contact of a side surface of the second positioning member 141 with an inner surface of the recessed portion. In summary, the second positioning member 141 may only be required that the positioning of the second positioning member 141 is made and when is moved in the Z direction, the second positioning member 141 is movable in the Z direction without rotating.

As the hole 203*c*, the hole is not limited to a through hole but may also be a recessed portion with which the projected portion is engageable. However, in the case where the third projection 141*d* is removed with the snap-off facilitating portion as a starting point in a state in which the positioning member 141 is kept mounted to the main assembly frame 201, the hole 203 may preferably be the through hole. That is, a constitution in which the third projection 141*d* is projected and exposed from the through hole may preferably be employed.

Further, the first and second engaging portions such as the first projection 141*b* and the second projection 141*c* may also be provided on one member or the other member of the above-described main assembly frame 201 and second positioning member 141. Further, the first and second portions-to-be-engaged such as the holes 203*a*, 203*b* are provided in a member, of the one member and the other member, provided with no first and second engaging portions. For example, the projected portion is provided on the one member, and the hole is provided in the other member. Further, the portion-to-be-engaged is not limited to the through hole such as the holes 203*a*, 203*b*, but may also be a recessed portion, having a bottom, capable of engageable with the projected portion.

Further, the fixing device 100 is positioned, and therefore the movable positioning member (the second positioning member in the above-described embodiment) may also be disposed on widthwise both sides of the fixing device 100. In other words, the first positioning member 140 in the above-described embodiment may also be constituted similarly as the second positioning member 141.

Further, a direction (predetermined direction) in which a unit such as the fixing device 100 is supported and the positioning and the positional adjustment of the unit relative to the main assembly frame are effected is not limited to the gravitational direction, but may also be another direction. For example, in the case where the fixing device 100 is urged in the X direction by an urging member such as a spring and is positioned to the main assembly frame with respect to the X direction, the positioning member is disposed on a side surface of the fixing device 100 with respect to the X direction so as to support an urging force with respect to the X direction. Then, this positioning member is made movable in the X direction later. In summary, the present invention may preferably be applicable to such a constitution that the positioning member is disposed with respect to a direction in which a load is exerted on the fixing device and the positioning and the positional adjustment are effected with respect to this direction.

INDUSTRIAL APPLICABILITY

According to the present invention, there is provided an image forming apparatus which has a constitution in which the fixing device can be easily positioned to the main assembly frame without effecting the positional adjustment and which is capable of effecting the positional adjustment easily in the case where re-adjustment is needed.

The invention claimed is:

1. A positioning member configured to be fixed to a main assembly frame of an image forming apparatus and configured to position a fixing device, comprising:

a mounting portion configured to mount one end of the fixing device with respect to a first direction substantially parallel to a longitudinal direction of the fixing device;

a first projected portion configured to be inserted into a first hole of the main assembly frame, wherein said first projected portion has a shape that said first projected portion is substantially immovable relative to the main assembly frame in a second direction substantially perpendicular to the first direction and is movable relative to the main assembly frame in a third direction substantially perpendicular to the first direction and the second direction;

a second projected portion configured to be inserted into a second hole of the main assembly frame, wherein said second projected portion has a shape that said second projected portion is substantially immovable relative to the main assembly frame in the second direction, and is movable relative to the main assembly frame in the third direction; and a third projected portion configured to be inserted into a third hole of the main assembly frame, wherein said third projected portion has a shape that said third projected portion is substantially immovable relative to the main assembly frame in the third direction substantially parallel to the first direction and is movable relative to the main assembly frame in the second direction;

wherein said third projected portion includes a snap-off facilitating portion which facilitates to snap off in order to permit movement of said positioning member relative to the main assembly frame in the third direction.

2. A positioning member according to claim 1, wherein with respect to the second direction, said first projected portion, said third projected portion and said second projected portion are disposed in this order.

3. A positioning member according to claim 2, wherein the third direction is substantially parallel to a gravitational direction.

4. A positioning member according to claim 1, wherein the third direction is substantially parallel to a gravitational direction.

5. A positioning member configured to be fixed to a main assembly frame of an image forming apparatus and configured to position a fixing device including a rotatable member for performing a fixing process, comprising:

a mounting portion configured to mount one end of the fixing device with respect to a first direction substantially parallel to an axial direction of the rotatable member;

a first projected portion configured to be inserted into a first hole of the main assembly frame, wherein said first projected portion has a shape that said first projected portion is substantially immovable relative to the main assembly frame in a second direction substantially perpendicular to the first direction and is movable relative to the main assembly frame in a third direction substantially perpendicular to the first direction and the second direction;

a second projected portion configured to be inserted into a second hole of the main assembly frame, wherein said second projected portion has a shape that said second projected portion is substantially immovable relative to the main assembly frame in the second direction, and is movable relative to the main assembly frame in the third direction; and a third projected portion configured to be inserted into a third hole of the main assembly frame, wherein said third projected portion has a shape that said third projected portion is substantially immovable relative to the main assembly frame in the third direction substantially parallel to the first direction and is movable relative to the main assembly frame in the second direction;

wherein said third projected portion includes a snap-off facilitating portion which facilitates to snap off in order to permit movement of said positioning member relative to the main assembly frame in the third direction.

6. A positioning member according to claim 5, wherein with respect to the second direction, said first projected portion, said third projected portion and said second projected portion are disposed in this order.

7. A positioning member according to claim 6, wherein the third direction is substantially parallel to a gravitational direction.

8. A positioning member according to claim 6, wherein the third direction is substantially parallel to a gravitational direction.

9. A positioning member according to claim 8, wherein said third projected portion is shorter in length with respect to the second direction than with respect to the third direction.

10. A positioning member configured to be fixed to a main assembly frame of an image forming apparatus and configured to position a fixing device, comprising:

a mounting portion configured to mount one end of the fixing device with respect to a first direction substantially parallel to a longitudinal direction of the fixing device;

a first projected portion configured to be inserted into a first hole of the main assembly frame, wherein said first projected portion has a shape that said first projected portion is substantially fitted in the first hole with respect to a second direction substantially perpendicular to the first direction while being loose in the first hole with respect to a third direction substantially perpendicular to the first direction and the second direction;

a second projected portion configured to be inserted into a second hole of the main assembly frame, wherein said second projected portion has a shape that said second projected portion is substantially fitted in the second hole with respect to the second direction, while being loose in the second hole with respect to the third direction; and a third projected portion configured to be inserted into a third hole of the main assembly frame, wherein said third projected portion has a shape that said third projected portion is substantially fitted in the third hole with respect to the third direction substantially parallel to the first direction while being loose in the third hole with respect to the second direction;

wherein said third projected portion includes a snap-off facilitating portion which facilitates to snap off in order to permit movement of said positioning member relative to the main assembly frame in the third direction.

11. A positioning member according to claim 10, wherein with respect to the second direction, said first projected portion, said third projected portion and said second projected portion are disposed in this order.

12. A positioning member according to claim 11, wherein the third direction is substantially parallel to a gravitational direction.

13. A positioning member according to claim 10, wherein the third direction is substantially parallel to a gravitational direction.

14. A positioning member according to claim 13, wherein said third projected portion is shorter in length with respect to the second direction than with respect to the third direction.

15. A positioning member according to claim 14, wherein said third projected portion is shorter in length with respect to the second direction than with respect to the third direction.

16. A positioning member configured to be fixed to a main assembly frame of an image forming apparatus and configured to position a fixing device including a rotatable member for performing a fixing process, comprising:

a mounting portion configured to mount one end of the fixing device with respect to a first direction substantially parallel to an axial direction of the rotatable member;

a first projected portion configured to be inserted into a first hole of the main assembly frame, wherein said first projected portion has a shape that said first projected portion is substantially fitted in the first hole with respect to a second direction substantially perpendicular to the first direction, while being loose in the first hole with respect to a third direction substantially perpendicular to the first direction and the second direction;

a second projected portion configured to be inserted into a second hole of the main assembly frame, wherein said second projected portion has a shape that said second projected portion is substantially fitted in the second hole with respect to the second direction, while being loose in the second hole with respect to the third direction; and a third projected portion configured to be inserted into a third hole of the main assembly frame, wherein said third projected portion has a shape that said third projected portion is substantially fitted in the third hole with respect to the third direction substantially parallel to the first direction while being loose in the third hole with respect to the second direction;

wherein said third projected portion includes a snap-off facilitating portion which facilitates to snap off in order to permit movement of said positioning member relative to the main assembly frame in the third direction.

17. A positioning member according to claim 16, wherein with respect to the second direction, said first projected portion, said third projected portion and said second projected portion are disposed in this order.

18. A positioning member according to claim 17, wherein the third direction is substantially parallel to a gravitational direction.

19. A positioning member according to claim 16, wherein the third direction is substantially parallel to a gravitational direction.

20. A positioning member according to claim 19, wherein said third projected portion is shorter in length with respect to the second direction than with respect to the third direction.

21. An image forming apparatus comprising:

(i) an image forming portion configured to form a toner image on a sheet;

(ii) a fixing device configured to fix the toner image formed on the sheet by said image forming portion;

(iii) a main assembly frame including a first portion-to-be-engaged, a second portion-to-be-engaged and a third portion-to-be-engaged; and (iv) positioning member configured to be fixed to said main assembly frame of an image forming apparatus and configured to position a fixing device said positioning member, comprising, (iv-i) a mounting portion configured to mount one end of the fixing device with respect to a first direction substantially parallel to a longitudinal direction of the fixing device;

(iv-ii) a first engaging portion configured to be engaged with said first portion-to-be-engaged, wherein said first engaging portion has a shape that said first engaging portion is substantially immovable relative to said main assembly frame in a second direction substantially perpendicular to the first direction and is movable relative to said main assembly frame in a third direction substantially perpendicular to the first direction and the second direction;

(iv-iii) a second engaging portion configured to be engaged with said second portion-to-be-engaged, wherein said second engaging portion has a shape that said second engaging portion is substantially immovable relative to said main assembly frame in the second direction, and is movable relative to said main assembly frame in the third direction; and (iv-iv) a third engaging portion configured to be engaged with said third portion-to-be-engaged, wherein said third engaging portion has a shape that said third engaging portion is substantially immovable relative to said main assembly frame in the third direction substantially parallel to the first direction and is movable relative to said main assembly frame in the second direction;

wherein said third portion-to-be-engaged is a hole and said third engaging portion is a projected portion, and wherein said third engaging portion includes a snap-off facilitating portion which facilitates to snap off in order to permit movement of said positioning member relative to the main assembly frame in the third direction.

22. An image forming apparatus according to claim 21, wherein with respect to the second direction, said first engaging portion, said third engaging portion and said second engaging portion are disposed in this order.

23. An image forming apparatus according to claim 22, wherein the third direction is substantially parallel to a gravitational direction.

24. An image forming apparatus according to claim 21, wherein the third direction is substantially parallel to a gravitational direction.

25. An image forming apparatus according to claim 24, wherein said third engaging portion is shorter in length with respect to the second direction than with respect to the third direction.

26. An image forming apparatus comprising:

(i) an image forming portion configured to form a toner image on a sheet;

(ii) a fixing device configured to fix the toner image formed on the sheet by said image forming portion;

(iii) a main assembly frame including a first portion-to-be-engaged, a second portion-to-be-engaged and a third portion-to-be-engaged; and (iv) a positioning member configured to be fixed to a main assembly frame of an image forming apparatus and configured to position a fixing device including a rotatable member for performing a fixing process, said positioning member comprising, (iv-i) a mounting portion configured to mount one end of the fixing device with respect to a first direction substantially parallel to an axial direction of the rotatable member;

(iv-ii) a first engaging portion configured to be engaged with said first portion-to-be-engaged, wherein said first engaging portion has a shape that said first engaging portion is substantially immovable relative to said main assembly frame in a second direction substantially perpendicular to the first direction and is movable relative to said main assembly frame in a third direction substantially perpendicular to the first direction and the second direction;

(iv-iii) a second engaging portion configured to be engaged with said second portion-to-be-engaged, wherein said second engaging portion has a shape that said second engaging portion is substantially immovable relative to said main assembly frame in the second direction, and is movable relative to said main assembly frame in the third direction; and (iv-iv) a third engaging portion configured to be engaged with said third portion-to-be-engaged, wherein said third engaging portion has a shape that said third engaging portion is substantially immovable relative to said main assembly frame in the third direction substantially parallel to the first direction and is movable relative to said main assembly frame in the second direction;

wherein said third portion-to-be-engaged is a hole and said third engaging portion is a projected portion, and wherein said third engaging portion includes a snap-off facilitating portion which facilitates to snap off in order to permit movement of said positioning member relative to the main assembly frame in the third direction.

27. An image forming apparatus according to claim 26, wherein with respect to the second direction, said first engaging portion, said third engaging portion and said second engaging portion are disposed in this order.

28. An image forming apparatus according to claim 26, wherein the third direction is substantially parallel to a gravitational direction.

29. An image forming apparatus according to claim 26, wherein the third direction is substantially parallel to a gravitational direction.

30. An image forming apparatus according to claim 29, wherein said third engaging portion is shorter in length with respect to the second direction than with respect to the third direction.

31. An image forming apparatus comprising:

(i) an image forming portion configured to form a toner image on a sheet;

(ii) a fixing device configured to fix the toner image formed on the sheet by said image forming portion;

(iii) a main assembly frame including a first portion-to-be-engaged, a second portion-to-be-engaged and a third portion-to-be-engaged; and (iv) a positioning member configured to be fixed to said main assembly frame of an image forming apparatus and configured to position a fixing device, said positioning member comprising, (iv-i) a mounting portion configured to mount one end of the fixing device with respect to a first direction substantially parallel to a longitudinal direction of the fixing device;

(iv-ii) a first engaging portion configured to be engaged with said first portion-to-be-engaged, wherein said first engaging portion has a shape that said first engaging portion is substantially fitted in said first portion-to-be-engaged with respect to a second direction substantially perpendicular to the first direction while being loose in said first portion-to-be-engaged with respect to a third direction substantially perpendicular to the first direction and the second direction;

(iv-iii) a second engaging portion configured to be engaged with said second portion-to-be-engaged, wherein said second engaging portion has a shape that said second engaging portion is substantially fitted in said second portion-to-be-engaged with respect to the second direction, while being loose in said second portion-to-be-engaged with respect to the third direction; and (iv-iv) a third engaging portion configured to be engaged with said third portion-to-be-engaged, wherein said third engaging portion has a shape that said third engaging portion is substantially fitted in said third portion-to-be-engaged with respect to the third direction substantially parallel to the first direction while being loose in said third portion-to-be-engaged with respect to the second direction;

wherein said third portion-to-be-engaged is a hole and said third engaging portion is a projected portion, and wherein said third projected portion includes a snap-off facilitating portion which facilitates to snap off in order to permit movement of said positioning member relative to the main assembly frame in the third direction.

32. An image forming apparatus according to claim 31, wherein with respect to the second direction, said first engaging portion, said third engaging portion and said second engaging portion are disposed in this order.

33. An image forming apparatus according to claim 32, wherein the third direction is substantially parallel to a gravitational direction.

34. An image forming apparatus according to claim 31, wherein the third direction is substantially parallel to a gravitational direction.

35. An image forming apparatus according to claim 34, wherein said third engaging portion is shorter in length with respect to the second direction than with respect to the third direction.

36. An image forming apparatus comprising:

(i) an image forming portion configured to form a toner image on a sheet;

(ii) a fixing device configured to fix the toner image formed on the sheet by said image forming portion;

(iii) a main assembly frame including a first portion-to-be-engaged, a second portion-to-be-engaged and a third portion-to-be-engaged; and (iv) a positioning member configured to be fixed to said main assembly frame of an image forming apparatus and configured to position a fixing device including a rotatable member for performing a fixing process, said positioning member comprising, (iv-i) a mounting portion configured to mount one end of the fixing device with respect to a first direction substantially parallel to an axial direction of the rotatable member;

(iv-ii) a first engaging portion configured to be engaged with said a first portion-to-be-engaged, wherein said first engaging portion has a shape that said first engaging portion is substantially fitted in said first portion-to-be-engaged with respect to a second direction substantially perpendicular to the first direction while being loose in said first portion-to-be-engaged with respect to a third direction substantially perpendicular to the first direction and the second direction;

(iv-iii) a second engaging portion configured to be engaged with said second portion-to-be-engaged, wherein said second engaging portion has a shape that said second engaging portion is substantially fitted in said second portion-to-be-engaged with respect to the second direction, while being loose in said second portion-to-be-engaged with respect to the third direction; and (iv-iv) a third engaging portion configured to be engaged with said third portion-to-be-engaged, wherein said third engaging portion has a shape that said third engaging portion is substantially fitted in said third portion-to-be-engaged with respect to the third direction substantially parallel to the first direction while being loose in said third portion-to-be-engaged with respect to the second direction;

wherein said third portion-to-be-engaged is a hole and said third engaging portion is a projected portion, and wherein said third engaging portion includes a snap-off facilitating portion which facilitates to snap off in order to permit movement of said positioning member relative to the main assembly frame in the third direction.

37. An image forming apparatus according to claim 36, wherein with respect to the second direction, said first engaging portion, said third engaging portion and said second engaging portion are disposed in this order.

38. An image forming apparatus according to claim 37, wherein the third direction is substantially parallel to a gravitational direction.

39. An image forming apparatus according to claim 36, wherein the third direction is substantially parallel to a gravitational direction.

40. An image forming apparatus according to claim 39, wherein said third engaging portion is shorter in length with respect to the second direction than with respect to the third direction.

41. A positioning member configured to be fixed to a main assembly frame of an image forming apparatus and configured to position a feeding unit for feeding a sheet, comprising:

a mounting portion configured to mount one end of the feeding unit with respect to a first direction substantially parallel to a longitudinal direction of the fixing device;

a first projected portion configured to be inserted into a first hole of the main assembly frame, wherein said first projected portion has a shape that said first projected portion is substantially immovable relative to the main assembly frame in a second direction substantially perpendicular to the first direction and is movable relative to the main assembly frame in a third direction substantially perpendicular to the first direction and the second direction;

a second projected portion configured to be inserted into a second hole of the main assembly frame, wherein said second projected portion has a shape that said second projected portion is substantially immovable relative to the main assembly frame in the second direction, and is movable relative to the main assembly frame in the third direction; and a third projected portion configured to be inserted into a third hole of the main assembly frame, wherein said third projected portion has a shape that said third projected portion is substantially immovable relative to the main assembly frame in the third direction substantially parallel to the first direction and is movable relative to the main assembly frame in the second direction;

wherein said third projected portion includes a snap-off facilitating portion which facilitates to snap off in order to permit movement of said positioning member relative to the main assembly frame in the third direction.

* * * * *